US012195829B2

(12) United States Patent
Kang

(10) Patent No.: US 12,195,829 B2
(45) **Date of Patent: *Jan. 14, 2025**

(54) HIGH STRENGTH AND HIGH THERMAL CONDUCTIVITY CASTING ALUMINUM ALLOY AND MANUFACTURING METHOD THEREOF

(71) Applicants: HYUNDAI MOTOR COMPANY, Seoul (KR); KIA CORPORATION, Seoul (KR)

(72) Inventor: Heesam Kang, Seoul (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 51 days.

This patent is subject to a terminal disclaimer.

(21) Appl. No.: 17/318,674

(22) Filed: May 12, 2021

(65) Prior Publication Data

US 2022/0145431 A1 May 12, 2022

(30) Foreign Application Priority Data

Nov. 11, 2020 (KR) ..... 10-2020-0149908

(51) Int. Cl.

| | |
|---|---|
| ***C22C 21/00*** | (2006.01) |
| ***B22D 21/00*** | (2006.01) |
| ***C22F 1/04*** | (2006.01) |

(52) U.S. Cl.
CPC ..... *C22C 21/00* (2013.01); *B22D 21/007* (2013.01); *C22F 1/04* (2013.01)

(58) Field of Classification Search
None
See application file for complete search history.

(56) References Cited

U.S. PATENT DOCUMENTS 4,080,223 A * 3/1978 Schoerner ..... C22C 21/00 148/438
6,387,540 B1 * 5/2002 Yoshidomi ..... F28F 21/084 138/143

FOREIGN PATENT DOCUMENTS

GB 1398128 A * 6/1975 ..... B22D 11/0602
WO WO-2017133415 A1 * 8/2017

* cited by examiner

*Primary Examiner* — George Wyszomierski
*Assistant Examiner* — Janell C Morillo
(74) *Attorney, Agent, or Firm* — Lempia Summerfield Katz LLC

(57) ABSTRACT

An Al—Ni—Fe-based alloy is based on an entire alloy of 100 wt % and includes: nickel (Ni) at 1.0 to 1.3 wt %; iron (Fe) at 0.3 to 0.9 wt %; silicon (Si) at 0.2 to 0.35 wt %; magnesium (Mg) at 0.3 to 0.5 wt %; and aluminum (Al) as a remainder, wherein a sum (Ni+Fe) of nickel and iron content is 1.6 wt % or more and 1.9 wt % or less.

7 Claims, 9 Drawing Sheets

HIGH STRENGTH AND HIGH THERMAL CONDUCTIVITY CASTING ALUMINUM ALLOY AND MANUFACTURING METHOD THEREOF

CROSS-REFERENCE TO RELATED APPLICATION

This application claims priority to and the benefit of Korean Patent Application No. 10-2020-0149908 filed in the Korean Intellectual Property Office on Nov. 11, 2020, the entire contents of which are incorporated herein by reference.

BACKGROUND

(a) Field of the Disclosure

The present disclosure relates to a high strength and high thermal conductivity casting aluminum alloy. More particularly, the present disclosure relates to a high strength and high thermal conductivity casting aluminum alloy having a yield strength of 200 MPa or more.

(b) Description of the Related Art

A high thermal conductivity aluminum alloy is used for vehicle parts that are useful to quickly transfer heat by being in contact with a heating element such as a heat sink.

Pure aluminum (Al) has high thermal conductivity, but it is not widely used due to poor mechanical properties and productivity.

Instead, in order to secure basic casting properties and minimum physical properties, alloys in which additive elements are minimized are used as high thermal conductivity alloys, which may be classified into extruded materials and casting materials.

Although the extruded material has excellent thermal conductivity, there is a problem of high cost when manufacturing parts because a material price is high and casting properties are inferior. In the case of the casting material, as the thermal conductivity is approximately 160 W/mK, there is a problem that the thermal conduction characteristic is inferior and/or a hot crack characteristic is poor. In addition, in the case of the casting material having the thermal conductivity of approximately 160 W/mK, the yield strength is 100 to 150 MPa, which is low for use as structural parts.

As described above, development of the aluminum alloy casting material with improved thermal conductivity and improved yield strength is desired.

The above information disclosed in this Background section is only to enhance understanding of the background of the disclosure. Therefore, the Background section may contain information that does not form the prior art that is already known in this country to a person of ordinary skill in the art.

SUMMARY

The present disclosure relates to a high strength and high thermal conductivity casting aluminum alloy and aims to provide an alloy that has yield strength of 200 MPa or more and also has excellent thermal conductivity.

An aluminum alloy for high strength and high thermal conductivity casting of the present disclosure is an Al—Ni—Fe-based alloy. The alloy includes, based an entire alloy of 100 wt %, nickel (Ni) at 1.0 to 1.3 wt %; iron (Fe) at 0.3 to 0.9 wt %; silicon (Si) at 0.2 to 0.35 wt %; magnesium (Mg) at 0.3 to 0.5 wt %; and aluminum (Al) as a remainder, wherein a sum (Ni+Fe) of nickel and iron content is 1.6 wt % or more and 1.9 wt % or less.

In the aluminum alloy for the high strength high thermal conductivity casting, a sum (Ni+Fe) of nickel and iron contents comprises or consists of 1.6 wt % or more and 1.9 wt % or less.

In the aluminum alloy for the high strength high thermal conductivity casting, a eutectic $FeNiAl_9$ phase is 5 wt % or more.

In the aluminum alloy for the high strength high thermal conductivity casting, an iron content is less than or equal to a nickel content.

In the aluminum alloy for the high strength high thermal conductivity casting, a fraction of an Al matrix phase in the alloy is 94 wt % or more.

In the aluminum alloy for the high strength high thermal conductivity casting, manganese (Mn) at 0.1 to 0.4 wt % may be further included.

In the aluminum alloy for the high strength high thermal conductivity casting, thermal conductivity is 180 W/mK or more, and yield strength is 200 MPa or more.

In the aluminum alloy for the high strength high thermal conductivity casting, other alloy elements may be further included. If included, the content of the other alloy elements is 0.5 wt % or less based on the total amount of the alloy.

A manufacturing method of an aluminum alloy with high strength and high thermal conductivity casting of the present disclosure includes: melting aluminum (Al); and adding iron (Fe), nickel (Ni), magnesium (Mg), and silicon (Si) to the melted aluminum to manufacture a molten metal for a solution; injecting the molten metal into a mold to be molded for a manufactured molded body; and age-heat treating the molded body.

In the adding of iron (Fe), nickel (Ni), magnesium (Mg), and silicon (Si), based on the entire alloy of 100 wt %, nickel (Ni) at 1.0 to 1.3 wt %, iron (Fe) at 0.3 to 0.9 wt %, silicon (Si) at 0.2 to 0.35 wt %, magnesium (Mg) at 0.3 to 0.5 wt % and a remainder aluminum (Al) are added.

In the adding of iron (Fe), nickel (Ni), magnesium (Mg), and silicon (Si), the magnesium content is larger than the silicon content.

The solution is heated at a temperature 500 to 600° C. for 1 hour to 10 hours.

The age-heat treatment is performed at a temperature range 180 to 200° C. for 3 hours to 5 hours.

The age-heat treatment is performed at a temperature range 220 to 250° C. for 1 hour to 3 hours.

The aluminum alloy for high strength and high thermal conductivity casting has a characteristic of thermal conductivity of 180 W/mK or more and yield strength of 200 MPa or more.

In addition, the alloy of the present disclosure is a heat treatment type of reinforced alloy and may control the strength or thermal conductivity of the alloy obtained by controlling the heat treatment condition.

In other words, the aluminum alloy of the present disclosure may have improved thermal conductivity and improved strength compared to the conventional casting type of aluminum alloy as well as a manufacturing cost reduction, and an increase of cooling efficiency may be improved as the thermal conductivity is improved.

DETAILED DESCRIPTION OF THE EMBODIMENTS

Hereinafter, embodiments of the present disclosure are described in detail. The embodiments, however, are provided as examples, and the present disclosure is not limited thereto, but is defined within the range of claims to be described below.

In present specification, unless explicitly described to the contrary, the word "comprise", and variations such as "comprises" or "comprising", should be understood to imply the inclusion of stated elements but not the exclusion of any other elements.

In present specification, singular expressions used herein include plural expressions unless they have expressly opposite meanings The terms "comprises" and/or "comprising" used in the specification specify particular features, regions, integers, steps, operations, elements, components, but do not preclude the presence or addition of other features, regions, integers, steps, operations, elements, and/or components thereof. Also, a singular form includes a plural form unless specifically stated in the text.

If not defined differently, all the terminologies including the technical terminologies and scientific terminologies used herein have meanings that are the same as or consistent with ones that those skilled in the art generally use.

Terms defined in dictionaries should be construed as having meanings corresponding to the related prior art documents and those stated herein, and are not to be construed as being ideal or official, if not so defined.

In some embodiments, detailed description of well-known technologies has been omitted to prevent the disclosure of the present disclosure from being interpreted ambiguously.

In addition, an aluminum alloy manufacturing method for high strength high thermal conductivity casting according to an embodiment of the present disclosure may further include additional eutectices in addition to suggested eutectices as needed.

In an embodiment of the present disclosure, a meaning of further including other alloy elements means that aluminum (Al) as a remainder is replaced by an additional amount of other elements.

The present disclosure is an Al—Ni—Fe-based alloy.

The Al—Ni—Fe-based alloy of the present disclosure is composed of nickel (Ni) at 1.0-1.3 wt %, iron (Fe) at 0.3-0.9 wt %, silicon (Si) at 0.2 to 0.35 wt %, and magnesium (Mg) at 0.3 to 0.5 wt %, and aluminum (Al) as a remainder based on 100 wt % of the entire alloy.

The alloy that satisfies the above-condition is an aluminum alloy with high strength and high thermal conductivity.

The addition of nickel (Ni) and iron (Fe) may secure excellent casting properties compared to pure aluminum while maintaining high thermal conductivity characteristics.

Figure 1:
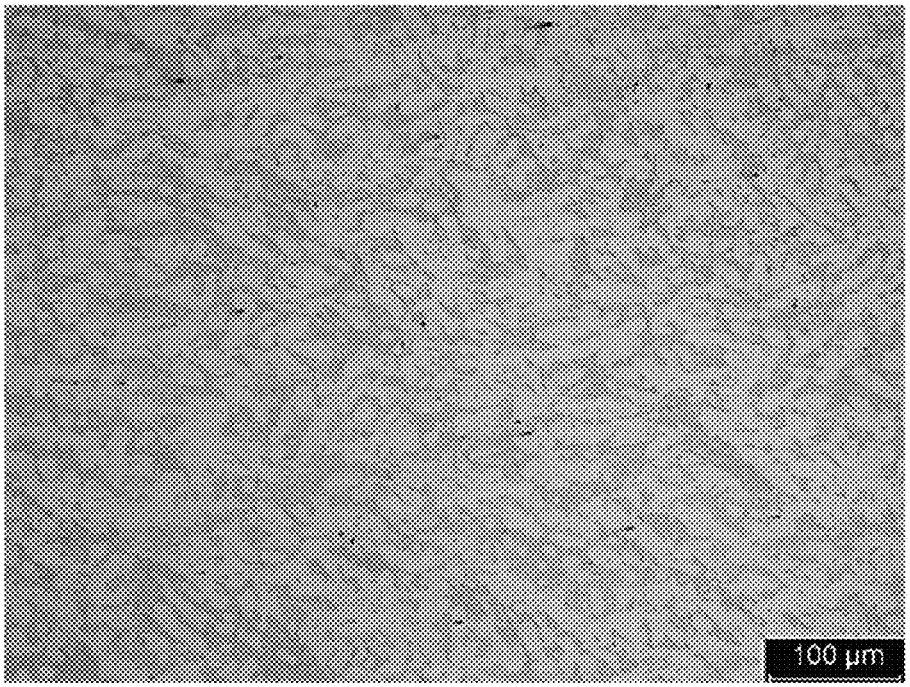
FIG. 1 is a photograph showing the microstructure of an Al—Ni—Fe-based alloy according to an embodiment of the present disclosure.
Figure 2:
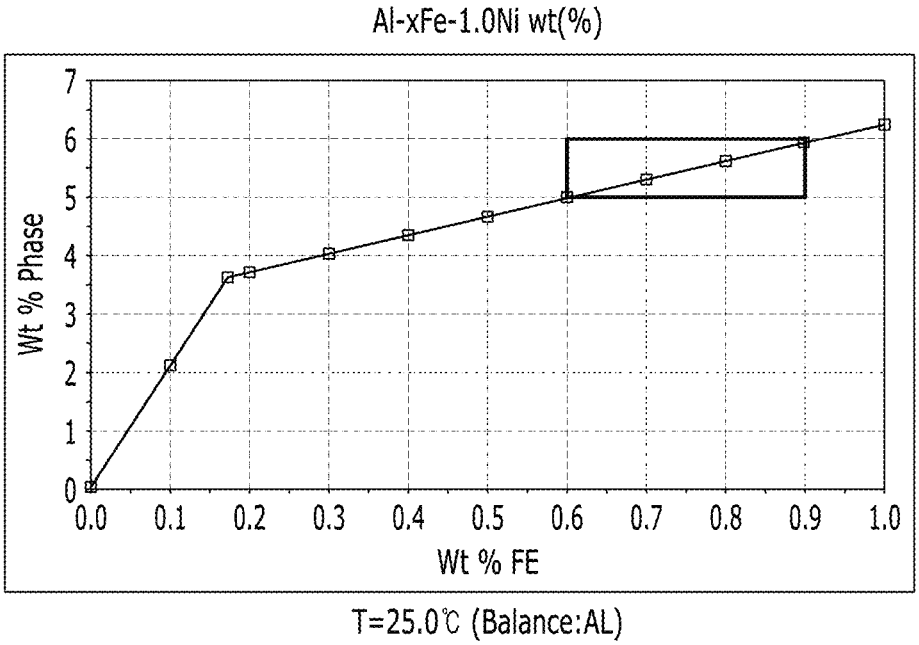
FIG. 2 is a graph showing a phase fraction of eutectic $FeNiAl_9$ according to a content of iron (Fe) when a nickel (Ni) content is 1.0 wt %.
Figure 3:
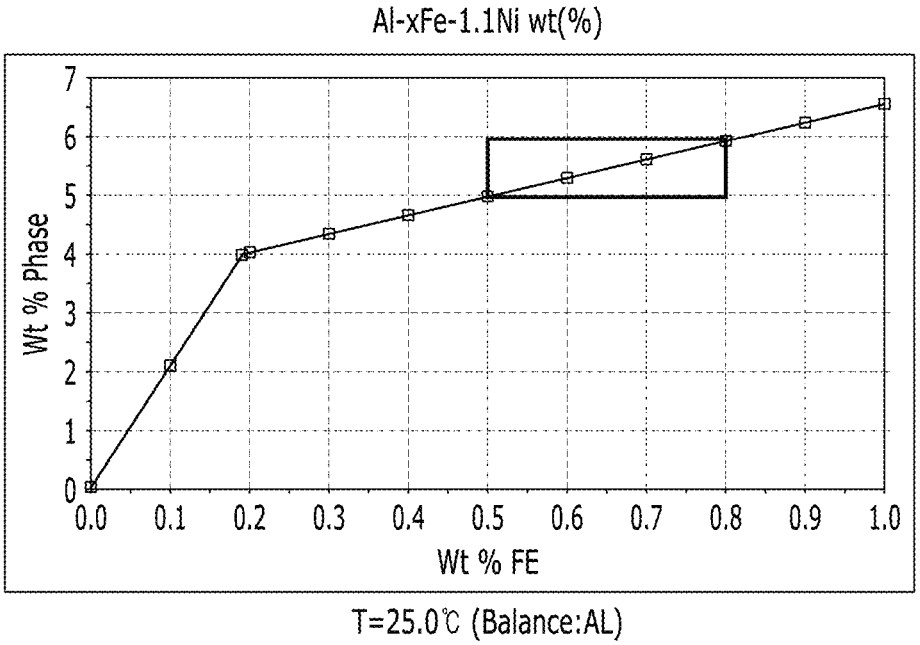
FIG. 3 is a graph showing a phase fraction of eutectic $FeNiAl_9$ according to a content of iron (Fe) when a nickel (Ni) content is 1.1 wt %.
Figure 4:
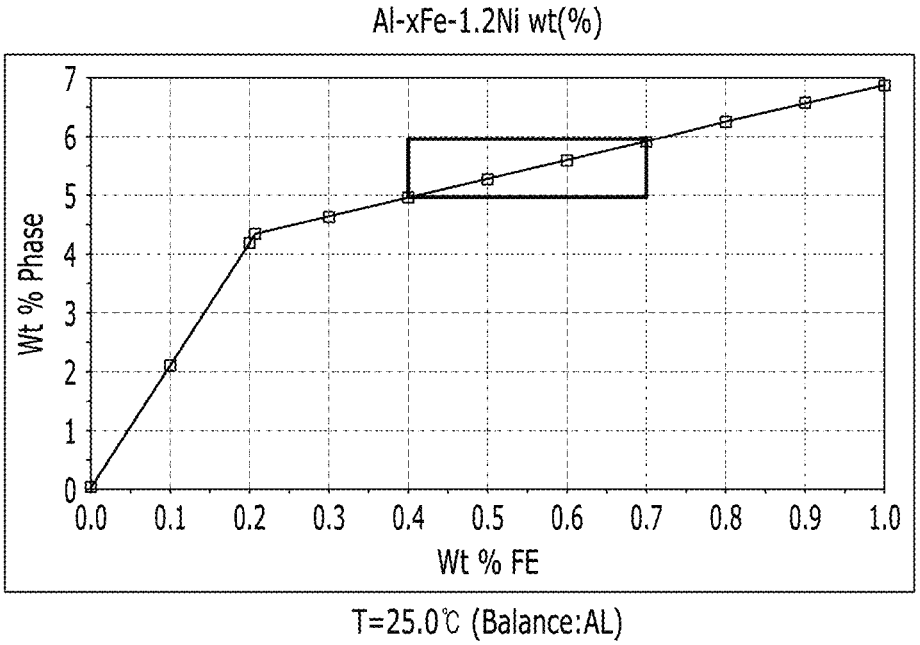
FIG. 4 is a graph showing a phase fraction of a eutectic $FeNiAl_9$ according to a content of iron (Fe) when a nickel (Ni) content is 1.2 wt %.
Figure 5:
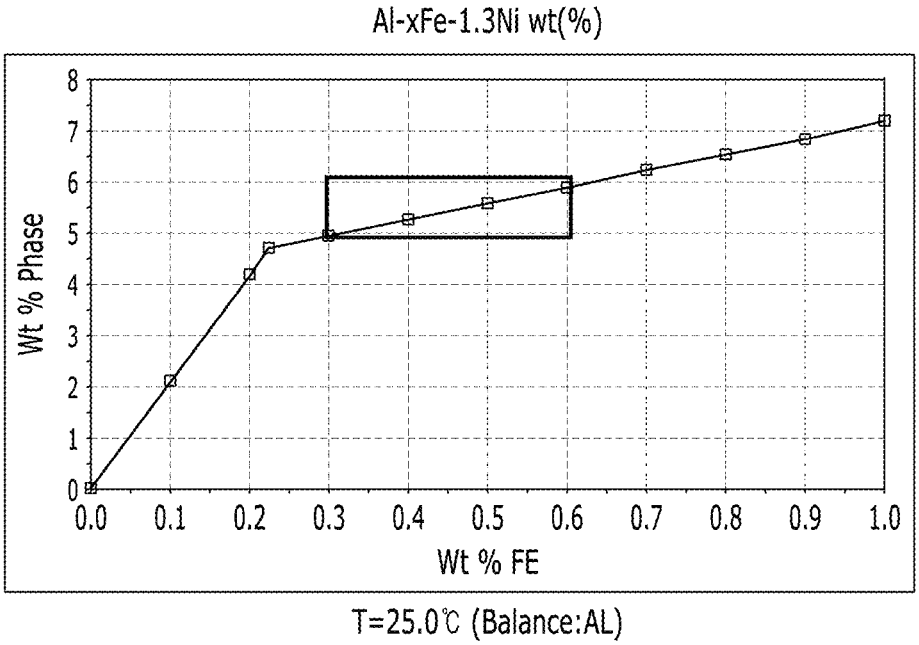
FIG. 5 is a graph showing a phase fraction of eutectic $FeNiAl_9$ according to a content of iron (Fe) when a nickel (Ni) content is 1.3 wt %.

FIG. 1 is a photograph showing the microstructure of an Al—Ni—Fe-based alloy according to an embodiment of the present disclosure. This microstructure comprises or consists of an aluminum matrix phase, which is a primary phase, and an Al—$FeNiAl_9$ phase, which is a eutectic phase. The $FeNiAl_9$ phase, which is the eutectic phase, is marked with a dark area in a case of FIG. 1.

In the alloy, the eutectic $FeNiAl_9$ phase is composed at 5 wt % or more.

Aluminum, nickel, and iron form the eutectic $FeNiAl_9$ phase in the alloy. When the sum range of the nickel and iron content is satisfied, a eutectic $FeNiAl_9$ phase may be generated at at least 5 wt %.

The sufficient casting properties may be secured when the eutectic $FeNiAl_9$ phase is present at at least 5 wt % or more in the alloy.

The fraction of the Al matrix phase in the alloy is composed at 94 wt % or more and 95 wt % or less.

The matrix phase means a basic matrix phase constituting the microstructure.

As the eutectic $FeNiAl_9$ phase in the alloy increases, the thermal conductivity of the entire alloy decreases. Therefore, in order to secure high thermal conductivity of 180 W/mK or more, the fraction of the Al matrix phase may be maintained at 94% or more. For this, the sum (Ni+Fe) of the nickel and iron content may be 1.9 wt % or less.

The sum (Ni+Fe) of the nickel and iron content is composed at 1.6 wt % or more and 1.9 wt % or less.

If less than 1.6 wt %, the eutectic $FeNiAl_9$ phase fraction is less than 5%, so that unfilling or hot cracking occurs in the product due to the lack of a liquidity of the alloy, In addition, when the sum (Ni+Fe) of the nickel and iron content is 1.9 wt % or more, the thermal conductivity decreases as the $FeNiAl_9$ generation increases.

The iron content in the alloy is equal to or less than the nickel content. When the iron content exceeds the nickel content, an additional $Al_3Fe$ phase is created, so that the thermal conductivity characteristic may be deteriorated.

Also, the content of magnesium (Mg) in the alloy is higher than that of silicon (Si).

To impart the strength to the alloy, magnesium and silicon are simultaneously added. When the alloy undergoes a heat treatment step, the $Mg_2Si$ phase precipitates and the strength is improved.

At this time, magnesium is added in an amount of 0.3 to 0.5 wt %. If the amount of the magnesium content is too small, there is no effect of improving the strength. On the other hand, if too much magnesium is added, the thermal conductivity is lowered without an additional effect of improving the strength. Thus, the above-range of magnesium content may be advantageous.

In addition, silicon is added at 0.2 to 0.35 wt %. If the silicon content is too small, the $Mg_2Si$ phase formed by being combined with magnesium in the heat treatment step is too small, so there is no effect of improving the strength. On the other hand, if the silicon content is too large, the thermal conductivity is lowered without additional strength improvement, thereby the range of the silicon content may be advantageous.

Particularly, in the case of silicon, when the $Mg_2Si$ phase is formed and remains, the thermal conductivity is rapidly lowered, so less than the magnesium content should be added. Specifically, it is desirable to add at least 0.1 wt % less than magnesium to prevent the thermal conductivity from being deteriorated due to the excess silicon.

The yield strength of the alloy according to the present disclosure in an embodiment is 200 MPa or more as described in an embodiment [Table 3].

The thermal conductivity of the alloy according to an embodiment of the present disclosure is 180 W/mK or more as described in the embodiment [Table 3].

As such, the present disclosure has excellent yield strength and thermal conductivity, thereby improving cooling efficiency of components and devices to which it is applied.

The alloy according to another embodiment of the present disclosure includes 0.1 to 0.4 wt % of manganese (Mn).

Manganese (Mn) may be combined with Fe and other elements (particularly copper (Cu), etc.) to suppress a solid solution of these elements and to obtain additional thermal conductivity improvement effects. In addition, workability may be improved through a hardness improvement.

The alloy according to another embodiment of the present disclosure further includes other alloy elements.

The other alloy elements refer to alloy elements other than aluminum (Al), nickel (Ni), and iron (Fe).

Specifically, the other alloy elements include copper (Cu).

The content of other alloy elements is 0.5 wt % or less based on the total amount of the alloy.

If the range is satisfied, the deterioration of the thermal conductivity due to the inclusion of other alloy elements may also be avoided.

The copper (Cu) content in the alloy may be added in an amount of 0 wt % or more and 0.2 wt % or less.

If the content range is exceeded, the thermal conductivity of the alloy may be deteriorated.

Next, a manufacturing method of the aluminum alloy for the high strength and high thermal conductivity casting is described. The description of the overlapping part with the contents described in the aluminum alloy for the high strength and high thermal conductivity casting is omitted.

The Manufacturing Method of the Aluminum Alloy for High Strength and High Thermal Conductivity Casting The manufacturing method of the aluminum alloy of high strength and high thermal conductivity casting according to an embodiment of the present disclosure includes: melting aluminum, adding iron (Fe), nickel (Ni), magnesium (Mg), and silicon (Si) to the melted aluminum to manufacture a molten metal to be a solution, injecting the molten solution to a mold to be molded; and heat-treating the molded body to be aged.

When aluminum is first melted and then iron (Fe), nickel (Ni), magnesium (Mg), and silicon (Si) are added, the iron (Fe), nickel (Ni), magnesium (Mg), and silicon (Si) with low solubility are stably alloyed in the aluminum to prevent segregation, thereby increasing a melting speed and thereby shortening a manufacturing time.

Specifically, after dissolving pure aluminum, iron (Fe), nickel (Ni), magnesium (Mg), and silicon (Si) are added in small portions to prepare a molten metal.

However, this discloses an embodiment of the present disclosure, and iron (Fe), nickel (Ni), magnesium (Mg), and silicon (Si) may be added to aluminum and then melted to produce the alloy.

The adding of iron (Fe) and nickel (Ni) may include nickel (Ni) at 1.0-1.3 wt %, iron (Fe) at 0.3-0.9 wt %, silicon (Si) at 0.2 to It 0.35 wt %, magnesium (Mg) at 0.3 to 0.5 wt %, and a remainder of aluminum (Al) based on 100 wt % of the entire alloy, The magnesium content is added at more than the silicon content. The detailed description of this is the same as that of the manufactured alloy.

The solution may be performed for 1 hour to 10 hours at a temperature of 500 to 600° C. The solution may be performed for 4 hours to 6 hours at the temperature of 530 to 540° C.

In the age-heat treatment, the condition thereof may be changed according to the properties of the final alloy product to be obtained.

First, when high strength with the yield strength of 230 MPa or more is desired, the age-heat treatment may be performed at 150° C. to 200° C. for 3 hours to 7 hours. If high strength with the yield strength of 230 MPa or more is desired, the age-heat treatment may be performed at 180° C. or more to 200° C. or less for 3 hours or more to 5 hours.

On the other hand, the yield strength is less than 200 MPa or more to less than 230 MPa, but if high thermal conductivity (about 180 W/mK or more) is desired, the age-heat treatment may be performed at more than 200° C. to 250° C. or less for 1 hour or more to 3 hours or less. If high thermal conductivity is desired, the age-heat treatment may be performed at more than 220° C. to 250° C. or less for 1 hour or more to 3 hours or less.

In other words, the aluminum alloy for the casting of the present disclosure may have desired characteristics through an additional heat treatment process after the molding.

The following examples illustrate the present disclosure in more detail. However, the following examples are only embodiments of the present disclosure and the present disclosure is not limited to the following embodiments.

Experimental Example 1: A Content Estimation of Nickel (Ni) and Iron (Fe) Satisfying the Casting Properties and the High Thermal Conductivity FIG. 2, FIG. 3, FIG. 4, and FIG. 5 are graphs showing a content of iron (Fe) depending on a nickel (Ni) content for simultaneously satisfying casting properties and high thermal conductivity. To obtain excellent casting properties, it is desirable to secure at least 5 wt % or more of the eutectic $FeNiAl_9$ phase.

However, in order to obtain the high thermal conductivity characteristic at the same time, the Al matrix phase fraction may also be at least 94 wt %. The result of calculating the iron (Fe) content for each nickel (Ni) content based on this is shown in Table 1.

TABLE 1

| | Content ratio (wt %) | | | Ni + Fe | $FeNiAl_9$ | Al |
|---|---|---|---|---|---|---|
| | Al | Ni | Fe content section | content (wt %) | phase (wt %) | matrix (wt %) |
| Example 1-1 | a remainder | 1.0 | 0.6-0.9 | 1.6-1.9 | 5-6 | 94-95 |
| Example 1-2 | a remainder | 1.1 | 0.5-0.8 | 1.6-1.9 | | |
| Example 1-3 | a remainder | 1.2 | 0.4-0.7 | 1.6-1.9 | | |
| Example 1-4 | a remainder | 1.3 | 0.3-0.6 | 1.6-1.9 | | |

Experimental Example 2: Casting Property Estimation Depending on a Eutectic $FeNiAl_9$ Phase Fraction Table 2 summarizes a casting property result depending on a eutectic $FeNiAl_9$ phase fraction.

TABLE 2

| $FeNiAl_9$ Phase fraction | | Chemical component (wt %) Al | Ni | Fe | Ni + Fe | | Casting property estimation result |
|---|---|---|---|---|---|---|---|
| Less than 5 wt % (Comparative Example 2) | Comparative Example 2-1 | Remainder | 1.0 | 0.3 | 1.3 | 1.3-1.5 | Unfilling or many hot cracks occur on a product due to a lack of a fluidity |
| | Comparative Example 2-2 | Remainder | 1.1 | 0.3 | 1.4 | | |
| | Comparative Example 2-3 | Remainder | 1.2 | 0.2 | 1.4 | | |
| | Comparative Example 2-4 | Remainder | 1.3 | 0.2 | 1.5 | | |
| 5 wt % or more (Example 2) | Example 2-1 | Remainder | 1.0 | 0.6 | 1.6 | 1.6-1.9 | Filling and crack No |
| | Example 2-2 | Remainder | 1.1 | 0.6 | 1.7 | | |
| | Example 2-3 | Remainder | 1.2 | 0.6 | 1.8 | | |
| | Example 2-4 | Remainder | 1.3 | 0.6 | 1.9 | | |

When a sum (Ni+Fe) of the nickel and iron content is less than 1.6 wt %, the eutectic $FeNiAl_9$ phase fraction is less than 5 wt %.

Figure 6:
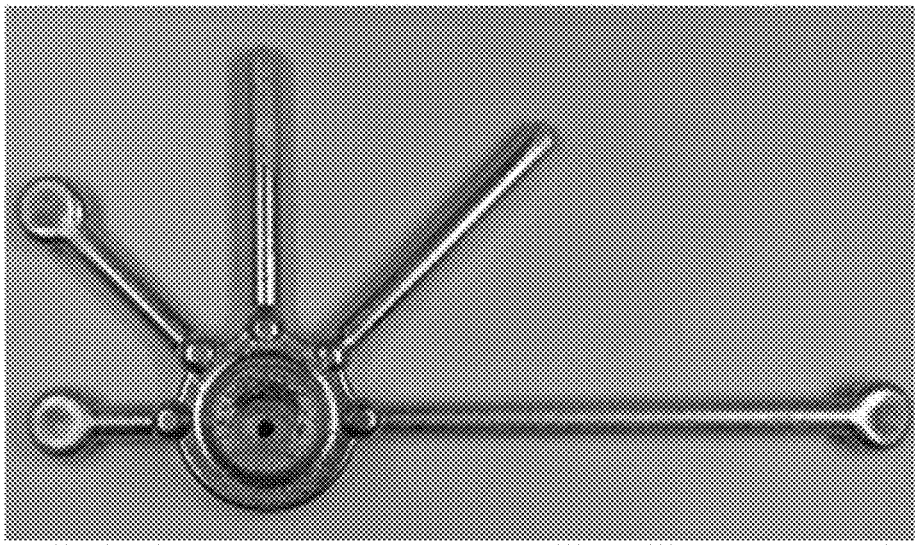
FIG. 6 shows a picture of a cast product when a phase fraction of $FeNiAl_9$ in Comparative Example 2 is less than 5 wt %.
Figure 7:
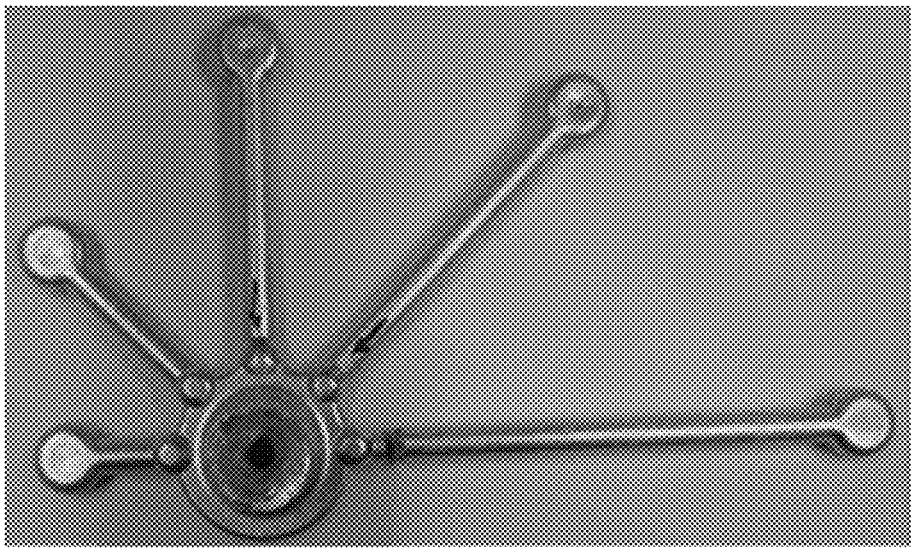
FIG. 7 shows a picture of a cast product when a phase fraction of $FeNiAl_9$ in Comparative Example 2 is less than 5 wt %.

FIG. 6 and FIG. 7 are photographs of a sample of Comparative example 2-1 and Comparative example 2-4. In the case of FIG. 6 and FIG. 7 in which the sum (Ni+Fe) of the nickel and iron content is less than 1.6 wt %, it may be confirmed that the unfilling and/or the hot cracks occur in the product due to lack of fluidity of the alloy.

When the sum (Ni+Fe) of the nickel and iron contents is 1.6 wt % or more, 5 wt % or more of the eutectic $FeNiAl_9$ phase is produced.

Figure 8:
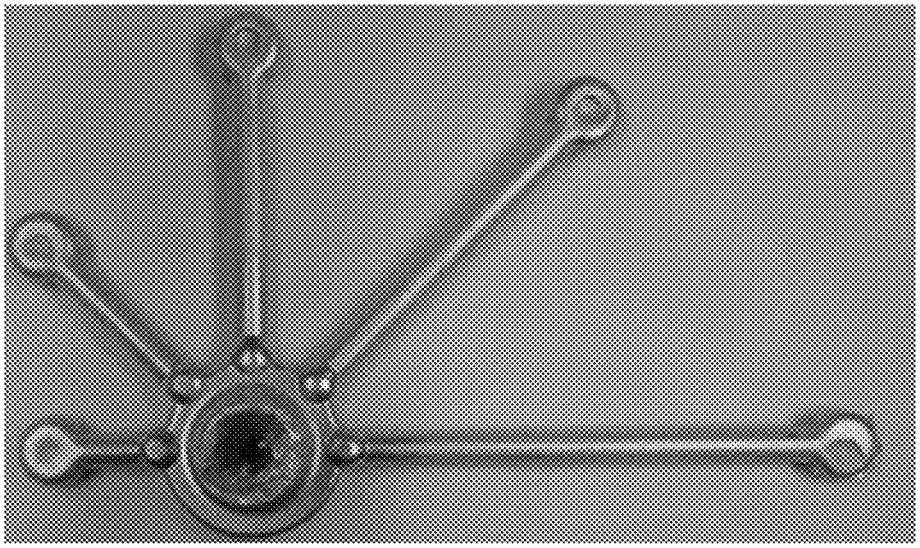
FIG. 8 shows a picture of a cast product when a phase fraction of $FeNiAl_9$ in Example 2 is 5 wt % more.
Figure 9:
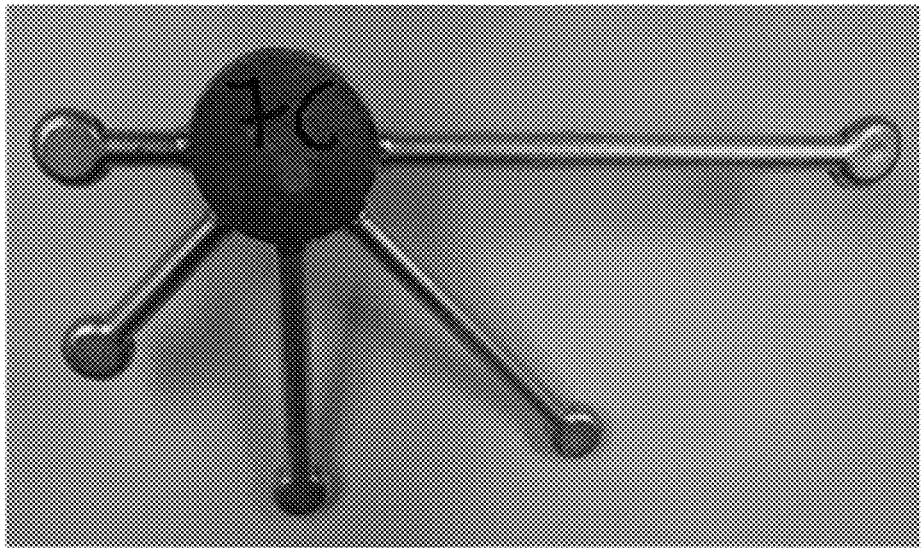
FIG. 9 shows a picture of a cast product when a phase fraction of $FeNiAl_9$ in Example 2 is 5 wt % more.

FIG. 8 and FIG. 9 are photographs of samples of Example 2-1 and Example 2-4, respectively. In the case of FIG. 8 and FIG. 9 in which the sum (Ni+Fe) of the nickel and iron content is 1.6 wt % or more, it may be confirmed that the products may be manufactured without problems of the casting properties such as the unfilled products or hot cracks.

Experimental Example 3: Estimation of Strength and Thermal Conductivity Depending on Mg and Si Addition Table 3 summarizes a change of strength and thermal conductivity depending on Mg and Si addition.

The solution is produced to prepare the molten metal by adding Ni, Fe, Mg, and Si to the molten Al to obtain the compositions of Table 3 below. The solution is produced at a temperature 535° C. for 6 hours. Next, the melted molten metal is molded to form the molded body and the age-heat treatment is performed. The age-heat treatment is performed at a temperature 230° C. for 2 hours.

For the strength, magnesium and silicon are simultaneously added. Magnesium and silicon are added together to the aluminum alloy molten metal, and a $Mg_2Si$ phase is extracted during the age-heat treatment and plays a roll improving the strength.

As shown in the Examples 3-1 to 3-3 of Table 3, it may be seen that when magnesium (Mg) with a content 0.3 to 0.5 wt % and silicon with a content 0.2 to 0.35 wt % is added, thermal conductivity of 180 W/mK and yield strength of 200 MPa or more may be simultaneously obtained.

On the other hand, as shown in Comparative Example 3-1, it may be confirmed that, if magnesium is added at less than 0.3 wt % or Si is added at less than 0.2 wt %, there is no effect of enhancing the yield strength. In addition, as in shown in Comparative Example 3-2, when 0.5 wt % or more of magnesium is added, it may be confirmed that the yield strength is enhanced, but the thermal conductivity is very poor. Also, as shown in Comparative Example 3-3 or Comparative Example 3-4, when Si is added in excess at 0.35 wt % or is not added at less than magnesium, it may be confirmed that the thermal conductivity is very rapidly deteriorated instead of enhancing the yield strength.

The present disclosure is not limited to the embodiments and may be produced in various forms, and it should be understood by those skilled in the art to which the present disclosure pertains that embodiments of the present disclosure may be implemented in other specific forms without modifying the technical spirit or essential features of the present disclosure. Therefore, it should be understood that the aforementioned embodiments are illustrative in terms of all aspects and are not limited.

TABLE 3

| | Content ratio (wt %) Al | Ni | Fe | Mg | Si | Mg > Si existence | Thermal conductivity (W/mK) | Yield strength (MPa) |
|---|---|---|---|---|---|---|---|---|
| Comparative Example 3-1 | Remainder | 1.1 | 0.8 | 0.25 | 0.15 | ○ | 195 | 120 |
| Example 3-1 | Remainder | 1.1 | 0.8 | 0.3 | 0.2 | ○ | 191 | 200 |
| Example 3-2 | Remainder | 1.1 | 0.8 | 0.4 | 0.3 | ○ | 188 | 210 |
| Example 3-3 | Remainder | 1.1 | 0.8 | 0.5 | 0.35 | ○ | 183 | 225 |
| Comparative Example 3-2 | Remainder | 1.1 | 0.8 | 0.55 | 0.35 | ○ | 173 | 260 |
| Comparative Example 3-3 | Remainder | 1.1 | 0.8 | 0.5 | 0.4 | ○ | 166 | 265 |
| Comparative Example 3-4 | Remainder | 1.1 | 0.8 | 0.5 | 0.5 | X | 160 | 265 |

What is claimed is:

1. An aluminum alloy consisting of, based on an entire alloy of 100 wt %:

1.0 to 1.3 wt % of nickel (Ni);

0.3 to 0.9 wt % of iron (Fe);

0.2 to 0.35 wt % of silicon (Si);

0.3 to 0.5 wt % of magnesium (Mg);

and aluminum (Al) as a remainder, wherein a sum of contents of the nickel and the iron within the aluminum alloy is in a range of 1.6 wt % to 1.9 wt %, wherein a eutectic FeNiAl9 phase is 5 wt % or more of the aluminum alloy, wherein a fraction of an Al matrix phase is 94 wt % or more of the aluminum alloy, wherein a thermal conductivity of the aluminum alloy is 180 W/mK or more, wherein a yield strength of the aluminum alloy is 200 MPa or more, wherein a content of the magnesium is larger than a content of the silicon within the aluminum alloy, and wherein a content of the iron is equal to or less than a content of the nickel within the aluminum alloy.

2. A vehicle heat-exchanger comprising:

an Al—Ni—Fe-based alloy, consisting of, based on an entire alloy of 100 wt %:

1.0 to 1.3 wt % of nickel (Ni);

0.3 to 0.9 wt % of iron (Fe);

0.2 to 0.35 wt % of silicon (Si);

0.3 to 0.5 wt % of magnesium (Mg);

and aluminum (Al) as a remainder, wherein a sum of the nickel and the iron within the Al—Ni—Fe alloy is in a range of 1.6 wt % to 1.9 wt %, wherein a eutectic FeNiAl9 phase is 5 wt % or more of the Al—Ni—Fe alloy, wherein a fraction of an Al matrix phase is 94 wt % or more of the Al—Ni—Fe alloy, wherein thermal conductivity of the Al—Ni—Fe alloy is 180 W/mK or more, wherein a yield strength of the Al—Ni—Fe alloy is 200 MPa or more, wherein a content of the magnesium is larger than a content of the silicon within the Al—Ni—Fe alloy, and wherein a content of the iron is equal to or less than a content of the nickel within the Al—Ni—Fe alloy.

3. A method of manufacturing an aluminum alloy of high strength and high thermal conductivity casting, consisting of, based on an alloy 100 wt %

1.0 to 1.3 wt % of nickel (Ni), 0.3 to 0.9 wt % of iron (Fe), 0.2 to 0.35 wt % of silicon (Si), 0.3 to 0.5 wt % of magnesium (Mg), and aluminum (Al) as a remainder, wherein a sum of the nickel and the iron within the aluminum alloy is in a range of 1.6 wt % to 1.9 wt %, wherein a eutectic FeNiAl9 phase is 5 wt % or more of the aluminum alloy, wherein a fraction of an Al matrix phase is 94 wt % or more of the aluminum alloy, wherein thermal conductivity of the aluminum alloy is 180 W/mK or more, wherein a yield strength of the aluminum alloy is 200 MPa or more, wherein a content of the magnesium is larger than a content of the silicon within the aluminum alloy, and wherein a content of the iron is equal to or less than a content of the nickel within the aluminum alloy, the manufacturing method comprising:

melting aluminum (Al);

adding iron (Fe), nickel (Ni), magnesium (Mg), and silicon (Si) to the melted aluminum to manufacture a molten metal for a solution;

injecting the molten metal into a mold to be molded for a manufactured molded body; and age-heat treating the molded body.

4. The method of manufacturing of claim 3, wherein the solution is heated at a temperature 500 to 600° C. for 1 hour to 10 hours.

5. The method of manufacturing of claim 3, wherein the age-heat treatment is performed at a temperature range of 180 to 200° C. for 3 hours to 5 hours.

6. The method of manufacturing of claim 3, wherein the age-heat treatment is performed at a temperature range of 220 to 250° C. for 1 hour to 3 hours.

7. A method of manufacturing a vehicle heat-exchanger comprising:

the method of claim 3.

* * * * *